US005277451A

United States Patent [19]

Garza

[11] Patent Number: 5,277,451

[45] Date of Patent: * Jan. 11, 1994

[54] INFORMATION PAD FOR CHECKBOOKS

[76] Inventor: Raul G. Garza, 12 Ollerton, Conroe, Tex. 77303

[ * ] Notice: The portion of the term of this patent subsequent to Oct. 29, 2008 has been disclaimed.

[21] Appl. No.: 974,967

[22] Filed: Nov. 12, 1992

Related U.S. Application Data

[63] Continuation-in-part of Ser. No. 923,216, Jul. 21, 1992, which is a continuation-in-part of Ser. No. 684,218, Apr. 12, 1991, Pat. No. 5,135,259.

[51] Int. Cl.[5] ..... B42D 3/00

[52] U.S. Cl. ..... 281/29; 281/31; 283/58; 283/64.1

[58] Field of Search ..... 281/29, 15.1, 31, 35, 281/58; 283/64.1, 58

[56] References Cited

U.S. PATENT DOCUMENTS 2,382,476 8/1945 Glasoe, Jr. ..... 281/31
5,060,979 10/1991 Garza ..... 281/31
5,114,009 5/1992 Johnston ..... 281/31 X
5,135,259 8/1992 Garza ..... 281/29

*Primary Examiner*—Mark Rosenbaum
*Assistant Examiner*—Willmon Fridie, Jr.
*Attorney, Agent, or Firm*—Harrison & Egbert

[57] ABSTRACT

An information pad for checkbooks including a checkbook cover of flexible member, a slotted member flexibly affixed to a surface of the checkbook cover, and an information receiving pad having a surface received within the slotted member. The slotted member includes an inner planar surface having an edge flexibly attached to the checkbook cover and an outer planar surface having a plurality of edges affixed to the inner planar surface. The information receiving pad includes a surface which is received between the inner planar surface and the outer planar surface. The inner planar surface has an outer edge which is seam welded along an edge of the checkbook cover. The information receiving pad includes a backing layer and a plurality of flexible sheets which overlie the backing layer. The backing layer extends between the inner planar surface and the outer planar surface of the slotted member.

20 Claims, 4 Drawing Sheets

INFORMATION PAD FOR CHECKBOOKS

RELATED APPLICATIONS

The present application is a continuation-in-part of U.S. patent application Ser. No. 07/923,216, filed on Jul. 21, 1992, and entitled "Notepad", presently pending. U.S. application Ser. No. 07/923,216 was a continuation-in-part of U.S. patent application Ser. No. 07/684,218, filed on Apr. 12, 1991, and entitled "Notepad for Checkbooks". U.S. application Ser. No. 07/684,218 issued as U.S. Pat. No. 5,135,259 on Aug. 4, 1992.

TECHNICAL FIELD

The present invention relates to checkbooks. More particularly, the present invention relates to checkbooks having information pads attached thereto.

BACKGROUND ART

In present checkbooks, it is often difficult to carry out computations, record information, and otherwise balance the checkbook without having an adjacent sheet of paper. Many times, checkbook users must conduct mathematical computations in the margins surrounding checkbooks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with use. The use of calculators in conjunction with checkbooks is a costly endeavor by the checkbook manufacturer and is generally found to be unsuitable for consumer use.

U.S. Pat. No. 4,911,476, issued on Mar. 27, 1990 to Raul G. Garza, the present inventor, incorporated a "magic slate" type of arrangement within a checkbook cover. After extensive usage, it was found that this "magic slate" was easy to incorporate into the checkbook. Specifically, the space was available which allowed the magic slate to be suitably folded within the confines of the cover of the checkbook. The magic slate was positioned so that the marking of the ledger or the marking of checks would not transmit written information onto the magic slate. Also, the magic slate could be stored such that the recorded information would no be erased by the separation of the associated impression layers of the magic slate. This was an extremely convenient arrangement for checkbook users.

U.S. Pat. No. 5,060,979, issued on Oct. 29, 1991, to the present inventor, describes an information pad for checkbooks. In particular, this invention utilizes a notepad having an adhesive hinge extending from a back surface of the notepad. The "adhesive hinge" fastens along an outer periphery of the plastic checkbook cover. In this manner, the notepad can fold inwardly or outwardly from the checkbook so as to provide a writing surface for persons utilizing the checkbook. After the notepad has been exhausted of its sheets of paper, the adhesive section may be removed so as to separate the notepad from the checkbook. A replacement notepad can be inserted in place of the original notepad.

As such, the present invention was developed so as to create a simpler and easier alternative to the use of the adhesive strip. In addition, the present invention offers an alternative technique for fastening the notepad or the "magic slate" to the periphery of a checkbook cover.

It is an object of the present invention to provide an information pad for use in conjunction with a checkbook.

It is another object of the present invention to provide an information pad that is attached to the checkbook in a simple manner.

It is still a further object of the present invention to provide an information pad that is very inexpensive, easy to manufacture, flexible, and easily utilized.

These and other objects and advantages of the present invention will become apparent from a reading of the attached specification and appended claims.

SUMMARY OF THE INVENTION

The present invention is an information pad for checkbook. This invention comprises a checkbook cover of flexible material, a slotted member flexibly attached to a surface of the checkbook cover, and an information receiving pad received within the slotted member and foldable within the area of the checkbook cover. The information receiving pad has a size less than one-half the area of the checkbook cover.

The slotted member includes an inner planar surface having an edge flexibly attached to the checkbook cover, and an outer planar surface having a plurality of edges affixed to the inner planar surface. A surface of the information receiving pad is received between the inner planar surface and the outer planar surface. This surface extends through the slot of the slotted member. The inner planar surface has an outer edge which is seam welded along an edge of the checkbook cover. This inner planar surface is arranged so as to be adjacent a surface of the checkbook cover. Specifically, the slotted member is affixed to an edge of the checkbook cover opposite the information receiving pad. This slotted member is foldable between a position within the checkbook cover and a position outward of the checkbook cover.

The information receiving pad includes a backing layer having a first planar surface and a second planar surface and a plurality of flexible sheets overlying the first planar surface of the backing layer. The flexible sheets are detachably connected to the backing layer for the purpose of receiving written information.

This checkbook cover has a fold portion which allows the cover to fold over another portion of the checkbook cover. The checkbook cover also includes an inner plastic sleeve which is fastened to an inner side of the cover. This inner plastic sleeve includes a slot which extends thereacross. The slot is used to receive a portion of the checkbook.

In an alternative embodiment, a pouch arrangement is provided so as to be received within a slot on a checkbook cover. The pouch has a slot for receiving a notepad therein. A backing surface of the pouch is insertable within the slot of the checkbook cover.

DETAILED DESCRIPTION OF THE INVENTION

Figure 1:
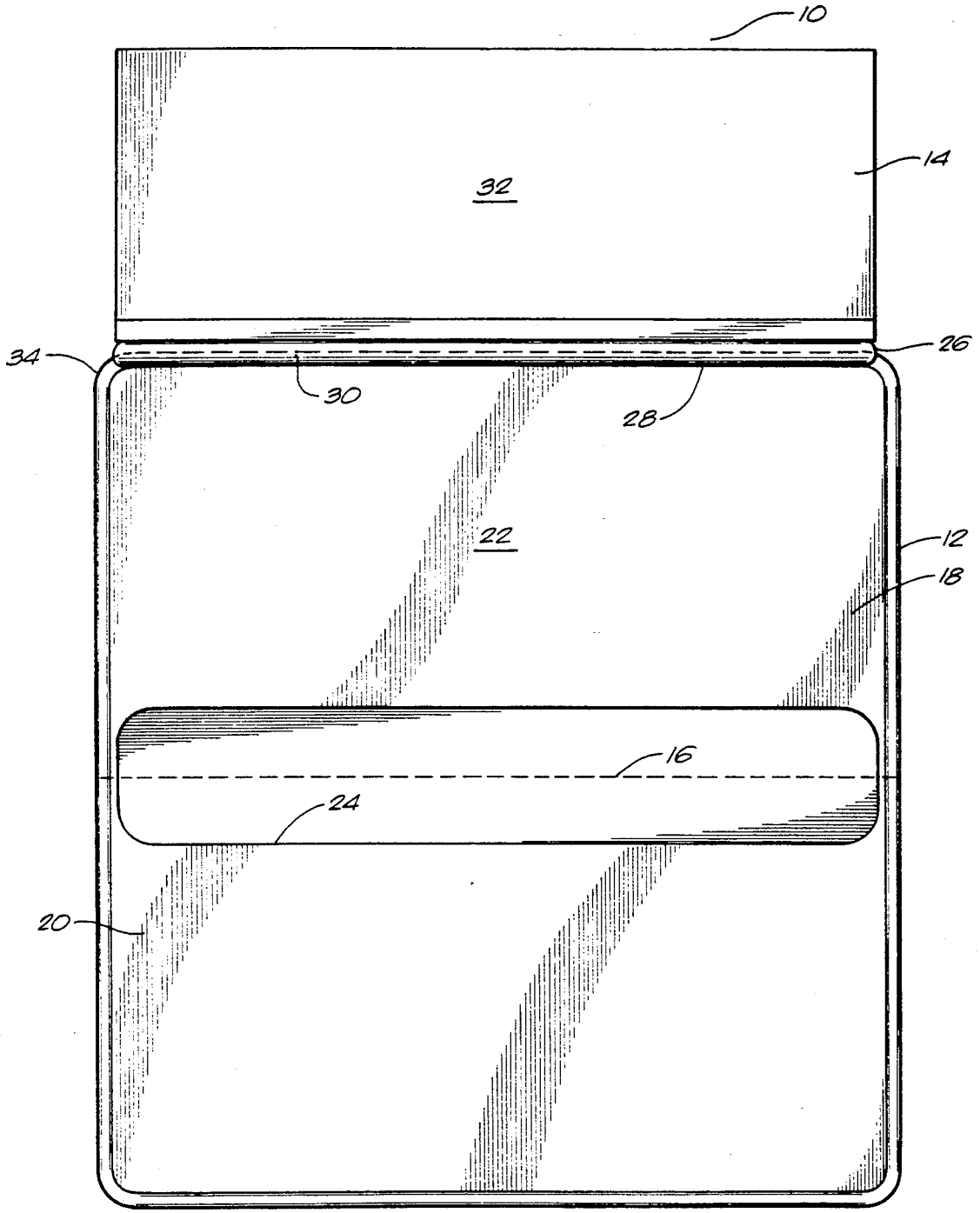
FIG. 1 is a frontal view of the information pad for checkbooks in accordance with the present invention showing the slotted member extending outwardly of the checkbook cover.

Referring to FIG. 1, there is shown at 10, the information pad for checkbooks in accordance with the present invention. In particular, the information pad at 10 comprises a checkbook cover 12 and the slotted member 14.

The checkbook cover 12 is typically comprised of a plastic material. Although the checkbook cover as illustrated at 12 is of plastic material, it is also possible for the checkbook cover 12 to be made of vinyl or leather. The choice of materials for checkbook cover 12 is simply a matter of design choice and is not intended to be a limitation on the present invention. The important limitation as to checkbook cover 12 is that the checkbook cover be of a flexible material suitable for folding. Ideally, the checkbook cover 12 should be of the type suitable for folding and placing in one's pocket. The checkbook cover 12 includes a fold portion 16. Fold portion 16 may be an indentation, as illustrated in FIG. 1, or a form in the cover itself. The purpose of the fold portion 16 is to allow checkbook half 18 to be folded over and onto checkbook half 20. The checkbook cover 12 also includes an inner plastic sleeve 22 that is fastened to the inner side of the cover 12. This inner plastic sleeve 22 has a slot 24 that extends thereacross. Slot 24 serves to receive the back cover of a checkbook. In operation, a single checkbook may be placed onto slot 24 by sliding the back cover of the checkbook into the area between the checkbook cover 12 (the backing) and the inner plastic sleeve 22. As such, the checkbook will be retained in the area of checkbook half 20. To close the checkbook, the checkbook half 18 is folded across fold portion 16 and over the top of the checkbook residing in slot 24.

Referring to FIG. 1, it can be seen that the slotted member 14 is affixed by portion 26 to the edge 34 of checkbook cover 12. The edge 34 is the edge of the checkbook cover which is opposite the position of the checkbook along the slot 24. The portion 26 of the slotted member 14 is seam welded along line 28 to the outer edge 30 of the checkbook cover 12. Although seam welding is specified herein, the slotted member 14 can be fastened by a variety of other means, including adhesion, forming, molding, and other means.

It can be seen that the slotted member 14 has a back surface 32 which is shown in an outwardly folded position away from the interior of the checkbook cover 28. Typically, in normal use, the surface 32 will be adjacent to the plastic sleeve 22 on the interior of the checkbook cover 12. In FIG. 1, the surface 32 is shown folded outwardly for the purpose of illustration. Surface 32 is the inner planar surface of the slotted member 14. The information pad will be received on the opposite side of the surface 32. When the slotted member 14 is folded inwardly of the checkbook cover 12, the checkbook cover 12 will fold over the top of the slotted member 14 so as to receive the information pad and the slotted member 14 within the area of the checkbook cover 12. This allows the pad to be used as a locator for the register. The pad is readily available for use when calculating checkbook balance.

Figure 2:
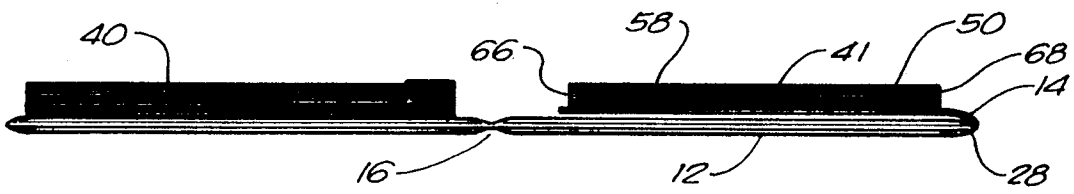
FIG. 2 is a side view of the information pad for checkbooks in accordance with the present invention.

Referring to FIG. 2, there is shown a side view of the checkbook cover 12, the information receiving pad 41, the slotted member 14, and checkbook 40. In FIG. 2, the checkbook cover 12 has a fold portion 16 roughly in the center of the checkbook. The checkbook 40 is shown as inserted into the slot 24. Checkbook 40 is a standard checkbook having a plurality of individual checks contained therein.

In FIG. 2, the configuration of the information receiving pad 41 is shown. Information receiving pad 41 is flexibly fastened by way of the slotted member 14 to the end 28 of the checkbook cover 12. It can be seen that the slotted member 14 is affixed to an edge of the checkbook cover 12. The slotted member 14 is flexible enough to allow the easy movement and folding of the information receiving pad 41 into the area of the checkbook cover 12. The information receiving pad 41 serves the purpose of receiving written information. Importantly, the information receiving pad 41 should have a size less than the surface area of the checkbook cover 12. The information receiving pad 41 includes a backing layer 50 that has a first planar surface and a second planar surface. The backing layer 50 is generally a rigid planar member. Typically, the backing layer 50 is made up of a solid cardboard material. Slotted member 14 has a slot (to be described hereinafter) which receives the backing layer 50 therein.

Overlying the first planar surface of the backing layer 50 are a plurality of flexible sheets 58. These flexible sheets 58 extend in surface-to-surface contact with each other and with the backing layer 50. Typically, these flexible sheets are made of a paper material. These sheets of paper 58 are detachably connected to the backing layer 50. The sheets of paper 58 are suitable for the receipt of information from either pen or pencil.

It can be seen in FIG. 2 that the longitudinal edges 66 of the sheets of paper are aligned. Additionally, the edge 68 of the sheets of paper 58 and the backing layer 50 are also aligned. The sheets are connected together along edge 68 by gluing, stapling, or other adhesive attachment. In this configuration, it is easy to lift the sheets 58 from the backing layer 50.

Figure 3:
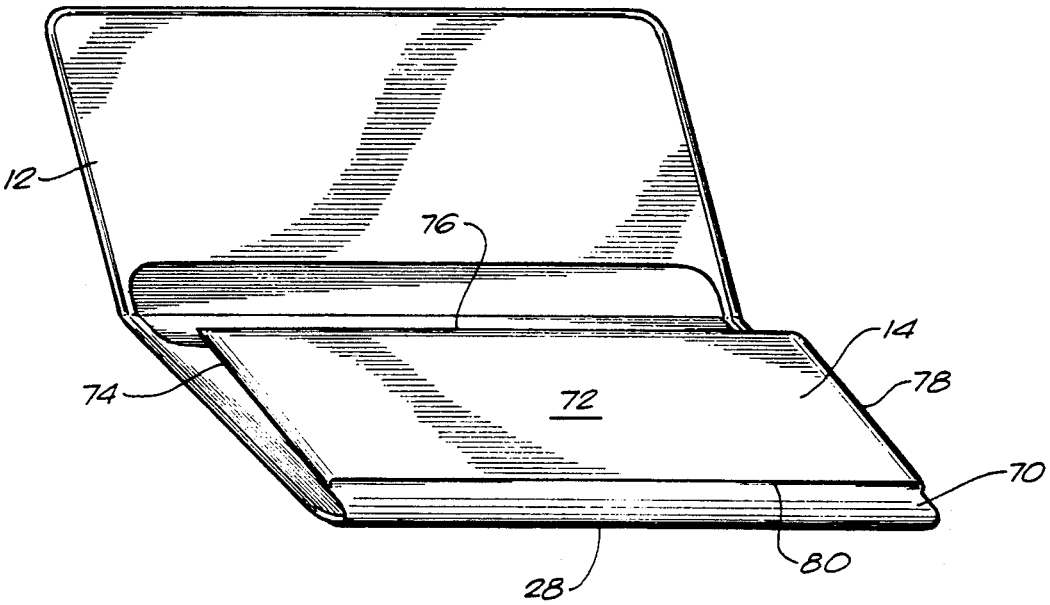
FIG. 3 is an isolated view, in perspective, of the checkbook cover and slotted member without the information pad.

FIG. 3 illustrates how the slotted member 14 is fastened and used in conjunction with the checkbook cover 12. Initially, it can be seen that the slotted member 14 has an inner planar surface 70 and an outer planar surface 72. With reference to FIG. 1, the inner planar surface corresponds to surface 32, as illustrated. In FIG. 3, the inner planar surface 70 is illustrated as extending toward the end 28 of checkbook cover 12. The inner planar surface 70 is seam welded along edge 28 to the checkbook cover 12. The outer planar surface 72 is fastened to the inner planar surface 70 along edges 74, 76, and 78. In essence, the outer planar surface 72 has a smaller area than the inner planar surface 70. By fastening the outer planar surface 72 along the sides and bottom of the inner planar surface 70, a slot 80 is formed between the inner planar surface and the outer planar surface 72. In essence, a "Pocket" is formed in the interface between the outer planar surface 72 and the inner planar surface 70. The slot 80 is suitable for receiving the backing layer from the information receiving pad. It can be seen that the slotted member 14 overlies a portion of the checkbook cover 12. The checkbook cover 12 is suitable for folding over the surfaces of the slotted member 14.

Figure 4:
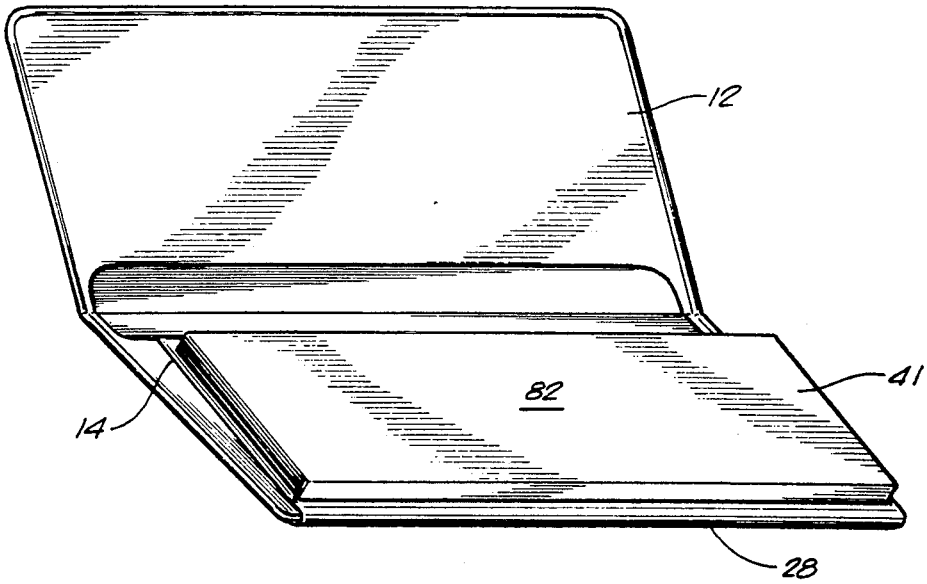
FIG. 4 is a perspective view of the information pad of the present invention.

FIG. 4 illustrates how the information receiving pad 41 is received within the slotted member 14 of the present invention. It can be seen that the information receiving pad 41 is a conventional notepad having a backing layer and a plurality of sheets overlying the backing layer. In the position illustrated in FIG. 4, the user of the checkbook cover 12 is free to write information on the top sheet 82 of the information receiving pad 41. The information receiving pad 41 is inserted into the slot 80 of the slotted member 14. Sheets from the pad 41 can be continually used until the supply of sheets is exhausted. At this time, the backing layer of the pad 41 can be removed from the slot 80. A new pad of paper can then be inserted therein.

It can be seen in FIG. 4 that the pad 41 is received within the area of the checkbook cover 12. The information receiving pad 41 has a size which is less than half of the area of the interior of the checkbook cover 12. The pad 41, in conjunction with the flexible slotted member 14, is free to hinge about the edge 28.

Figure 5:
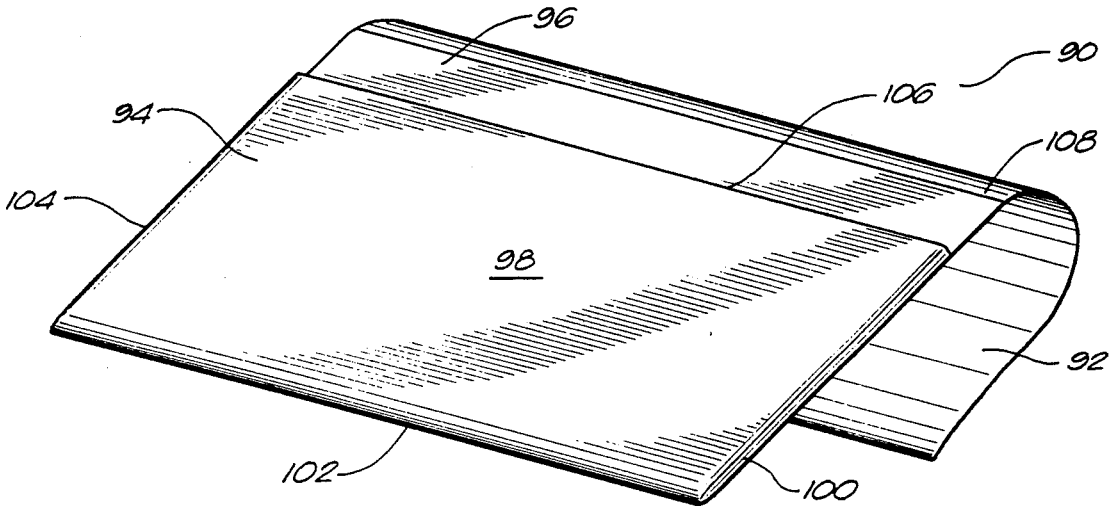
FIG. 5 is a perspective view of an alternative embodiment of the slotted pouch for receiving notepads as used with checkbooks in accordance with the present invention.

Referring to FIG. 5, there is shown an alternative embodiment 90 of the present invention. The embodiment 90 is essentially a slotted member which includes an insert surface 92 which is suitable for allowing the slotted portion 94 to be inserted within a slot formed in the cover of a checkbook. The slotted member 94 is comprised of an inner planar surface 96 and an outer planar surface 98. The inner planar surface 96 is fastened to the outer planar surface 98 along edges 100, 102 and 104. A slot is formed at 106 so as to allow a backing surface of a notepad to be inserted between the inner planar surface 96 and the outer planar surface 98.

The backing surface 92 extends from the edge 108 of the inner planar surface 96. The backing surface 92 is of a type that can be easily inserted into a slot formed within the lining of a checkbook cover. The backing surface 92 is generally of a flat configuration.

Figure 6:
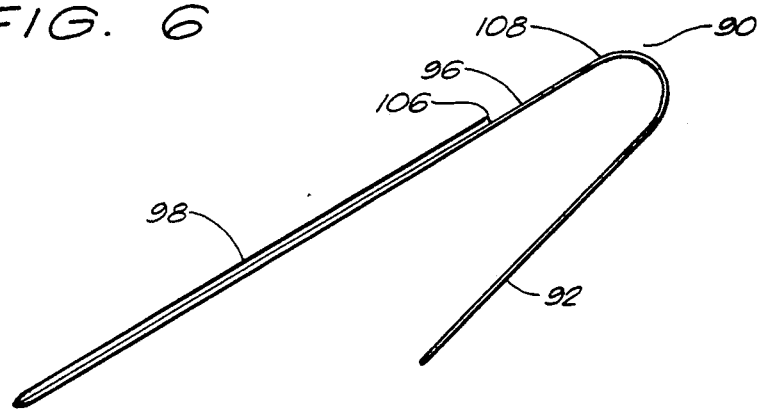
FIG. 6 is a side view of the alternative embodiment of FIG. 5.

FIG. 6 is a side view of the embodiment 90. It can be seen that the backing surface 92 extends downwardly from the upper edge 108 of the inner planar surface 96. The outer planar surface 98 is fastened along the edges of the inner planar surface 96 so as to form slot 106 therebetween. The relationship of the inner planar surface 96 and the outer planar surface 98 forms a "pouch" so as to receive a notepad therein. The backing surface 92 can be easily inserted into a slot formed on a checkbook cover.

The present invention offers an improvement over the prior art in various ways. First, the present invention allows calculations to be carried out on the information pad, names to be recorded, dates to be recorded, and other vital information recorded. The positioning of the information receiving pad along an edge of the checkbook is quite beneficial. This keeps the pad 41 away from the checkbook ledger or the checkbook itself. It is maintained in a convenient location for use.

The embodiments as illustrated and discussed in this specification are intended only to teach those skilled in the art the best way known by the inventor to make and use the invention. Nothing in the specification should be considered as limiting the scope of the present invention. Many changes could be made by those skilled in the art to produce equivalent systems without departing from the invention. The present invention should only be limited by the following claims and their legal equivalents.

I claim:

1. An information pad for checkbooks comprising:

a checkbook cover of flexible material, said checkbook cover having a slotted member flexibly attached to a surface of said checkbook cover; and information receiving means for receiving written information, said information receiving means having a size less than one-half the area of said checkbook cover, said information receiving means having a surface received within said slotted member, said information receiving means foldable within the area of said checkbook cover.

2. The information pad of claim 1, said slotted member comprising:

an inner planar surface having an edge flexibly attached to said checkbook cover; and an outer planar surface having a plurality of edges affixed to said inner planar surface, said surface of said information receiving means received between said inner planar surface and said outer planar surface.

3. The information pad of claim 2, said inner planar surface having an outer edge seam welded along an edge of said checkbook cover, said inner planar surface adjacent a surface of said checkbook cover.

4. The information pad of claim 3, said edge of said checkbook cover being opposite said information receiving means, said slotted member foldable between a position within said checkbook cover to a position outward of said checkbook cover.

5. The information pad of claim 2, said inner planar surface having a larger area than said outer planar surface, said outer planar surface affixed to said inner planar surface distal said edge flexibly attached to said checkbook cover.

6. The information pad of claim 1, said information receiving means comprising:

a backing layer having a first planar surface and a second planar surface; and a plurality of flexible sheets overlying said first planar surface of said backing layer, said flexible sheets being detachably connected to said backing layer for receiving written information.

7. The information pad of claim 1, said checkbook cover comprised of a plastic material, said checkbook cover having a fold portion such that part of said cover may fold over another portion of said checkbook cover.

8. The information pad of claim 7, said checkbook cover having an inner plastic sleeve fastened to an inner side of said cover, said inner plastic sleeve having a slot extending thereacross, said slot for receiving a portion of a checkbook.

9. The information pad of claim 6, said backing layer and said plurality of flexible sheets being connected along a longitudinal edge of said information receiving means.

10. The information pad of claim 6, said backing layer being a rigid planar member of cardboard material.

11. An apparatus comprising:

a checkbook;

a checkbook cover of flexible material, said checkbook cover having means for receiving said checkbook therein, said checkbook cover foldable and having a size suitable for covering an entire surface of said checkbook; and a slotted member having an edge affixed to said checkbook cover, said slotted member positioned within said checkbook cover away from said checkbook, said slotted member having a slot for receiving an information receiving pad therein.

12. The apparatus of claim 11, said slotted member comprising:

an inner planar surface having an edge flexibly attached to said checkbook cover; and an outer planar surface having a plurality of edges affixed to said inner planar surface, the information receiving pad receivable between the inner planar surface and the outer planar surface.

13. The apparatus of claim 11, said slotted member comprising a flexible member having an outer edge seam welded to an outer edge of said checkbook cover.

14. The apparatus of claim 13, said outer edge being opposite said checkbook, said slotted member foldable between a position within said checkbook cover and a position outward of said checkbook cover.

15. The apparatus of claim 11, further comprising:

an information receiving pad for receiving written information, said information receiving pad having a size less than one-half the area of said checkbook cover, said information receiving pad having a surface received within said slotted member.

16. The apparatus of claim 15, said information receiving pad comprising:

a backing layer having a first planar surface and a second planar surface; and a plurality of flexible sheets overlaying said first planar surface of said backing layer, said flexible sheets being detachably connected to said backing layer for receiving written information.

17. The apparatus of claim 16, said backing layer and said plurality of flexible sheets being connected along a longitudinal edge of said information receiving pad.

18. An apparatus comprising:

a flexible cover;

a slotted member having an edge affixed to an edge of said flexible cover, said slotted member extending inwardly of said flexible cover; and information receiving means for receiving written information, said information receiving means having a size less than one-half the area of said flexible cover, said information receiving means having a surface received within said slotted member, said information receiving means foldable within an area of said flexible cover.

19. The apparatus of claim 18, said slotted member comprising:

an inner planar surface having an edge flexibly attached to said flexible cover; and an outer planar surface having a plurality of edges affixed to said inner planar surface, said surface of said information receiving means received between said inner planar surface and said outer planar surface.

20. The apparatus of claim 18, said information receiving means comprising:

a backing layer having a first planar surface and a second planar surface; and a plurality of flexible sheets overlaying said first planar surface of said backing layer, said flexible sheets being detachably connected to said backing layer for receiving written information.

* * * * *